United States Patent [19]

Reed et al.

[11] 4,323,343

[45] Apr. 6, 1982

[54] BURNER ASSEMBLY FOR SMOKELESS COMBUSTION OF LOW CALORIFIC VALUE GASES

[75] Inventors: Robert D. Reed; Robert E. Schwartz, both of Tulsa, Okla.

[73] Assignee: John Zink Company, Tulsa, Okla.

[21] Appl. No.: 118,613

[22] Filed: Feb. 4, 1980

[51] Int. Cl.[3] ..... F23D 13/20

[52] U.S. Cl. ..... 431/202; 431/350; 431/352

[58] Field of Search ..... 431/202, 351, 352, 350

[56] References Cited

U.S. PATENT DOCUMENTS 4,105,394 8/1978 Reed et al. ..... 431/202

4,188,183 2/1980 Zink et al. ..... 431/202

*Primary Examiner*—Carroll B. Dority, Jr.

*Attorney, Agent, or Firm*—Head & Johnson

[57] ABSTRACT

A burner assembly for the smokeless flare burning of low calorific value gases, or diluted hydrocarbon gases, which comprises a plurality of separate burner heads arranged in a horizontal array, each of the burner heads being mounted on top of a vertical pipe through which the low calorific gases are supplied. A plurality of hollow radial arms are inserted into the wall of the head, arranged in equally-spaced array, each of the arms having a plurality of ports in the top surfaces, near the ends of the arms. These ports are of selected size and selected angle of their axes, which are tilted inwardly towards the central axis of the burner heads. Additionally, there is between each pair of arms at least one port drilled downwardly from the inside of the burner head, at a selected angle, so that jets of gas will impinge downwardly on an annular plate positioned beneath the arms, to close off the vertical flow to the space between the arms. The arms are surrounded by a shallow cylindrical wall which is perforated in a selected uniform pattern over its entire surface. Over each of the arms is a cylindrical tube against which the gas jets, which can be sonic, impinge, so that the jets are diffused throughout the entire volume between the arms and above the arms. Air diffuses inwardly through the surrounding perforated wall to mix quietly with the gas so as to maintain a continuous combustion, with sufficient air to prevent the formation of smoke.

5 Claims, 4 Drawing Figures

BURNER ASSEMBLY FOR SMOKELESS COMBUSTION OF LOW CALORIFIC VALUE GASES

BACKGROUND OF THE INVENTION

1. Field of the Invention

This invention lies in the field of smokeless combustion of low calorific value gases, which may be hydrocarbon gases which are diluted by non-combustible gases, such as nitrogen, argon, or carbon dioxide. Also, when the temperature is high enough, water vapor may likewise dilute the gases to form low calorific value gases.

2. Description of the Prior Art

In the prior art there are numerous examples of apparatus for the combustion of calorific rich gases to burn completely without smoke. The problem is considerably simpler with the high calorific value gases, since a turbulent stream of gas and air can mix thoroughly without blowing out the flame.

On the other hand, with calorifically lean gases, the smokeless combustion is difficult, because it is difficult to maintain flame retention for continuous burning of the gas. Thus, while a thorough mixing of the gas and air is required, the velocity of the burning gases must be low enough so that a continuous flame can be maintained, to continuously reignite the gas newly entering the combustion area.

SUMMARY OF THE INVENTION

It is a primary object of this invention to provide a burner head which will smokelessly burn calorifically lean gases.

These and other objects are realized and the limitations of the prior art are overcome in this invention by providing one or a plurality of burner heads, each of which comprises a central hub with a plurality of radiating hollow arms equally spaced in a horizontal plane. An annular plate closes off the bottom of the head surrounding the hub so that there is no vertical air movement upwardly between the arms. A shallow cylindrical wall surrounds the arms and extends upwardly a selected distance above the tops of the arms. This wall is perforated with a large plurality of openings, of selected diameter in a selected two-dimensional array, over substantially the entire area of the wall.

Gases are supplied through the vertical pipe into the head, and into the arms, which are closed off at their outer ends. A plurality of ports are drilled on the top surface of each of the arms. These ports are of selected diameter and radial spacing and are drilled with their axes at a selected small angle, leaning towards the vertical axis of the head. This angle may be in the range of 5° to 30°.

Mounted over the ports are a plurality of tubular nipples which are tilted so as to be substantially perpendicular to the direction of the axes of the ports.

There is a further series of ports, at least one between each of the adjacent pairs of arms, drilled through the wall of the hub, and headed in a direction downwardly from the horizontal at a selected angle, from the inside to the outside of the hub. The pressure of lean gas, which is supplied to the head, is sufficiently high, so that the jets of gas which issues from each of the ports are at excessive, or up to critical (sonic) velocity. The jets from the top surfaces of the arms impinge on the under surface of the nipples and are deflected in a diffuse way throughout the space above and between the arms. Also the jets which impinge downwardly on the annular plate also spread in a diffuse way throughout the volume between the arms.

Combustion air surrounding the outer wall of the head can diffuse through the openings, inwardly, to the space above, between and below the arms to mix with the once turbulent gas to create stable overall burning.

While the gas issues from the ports at excessive or critical velocity, these jets do not progress any substantial distance as jets, but are broken up into smaller multidirectional flows at reduced velocity and moving in all different directions, so as to aspirate air into the space, and to mix rapidly with the air, so that when ignited there will be a diffuse flame, which will rise in a column above the burner head.

In the absence of a consolidated column of high velocity gas and flame, there is little chance that the flame will not be retained and will, therefore, ignite the newly issuing gas, so that a continuous flame will be provided to burn the mixture of lean gas and air.

Since the jets are broken down by impingement on a nearby surface, so that there is no commonly-directed substantial flow of gas and flame, the mixing of the air is provided without undue turbulence, which could cause the flame to blow out. The diffuse mixture of air and gas can be ignited and will be retained through substantially the entire volume between the arms, and above the arms, and will thus reignite the gas and air mixture forming at the lower levels, in the volume between and above the arms.

BRIEF DESCRIPTION OF THE DRAWINGS

These and other objects and advantages of this invention and a better understanding of the principles and details of the invention will be evident from the following description taken in conjunction with the appended drawings, in which FIG. 1 is taken across the plane 1—1 of FIG. 2; and FIG. 2 is taken across plane 2—2 of FIG. 1.

DESCRIPTION OF THE PREFERRED EMBODIMENTS

Figure 1:
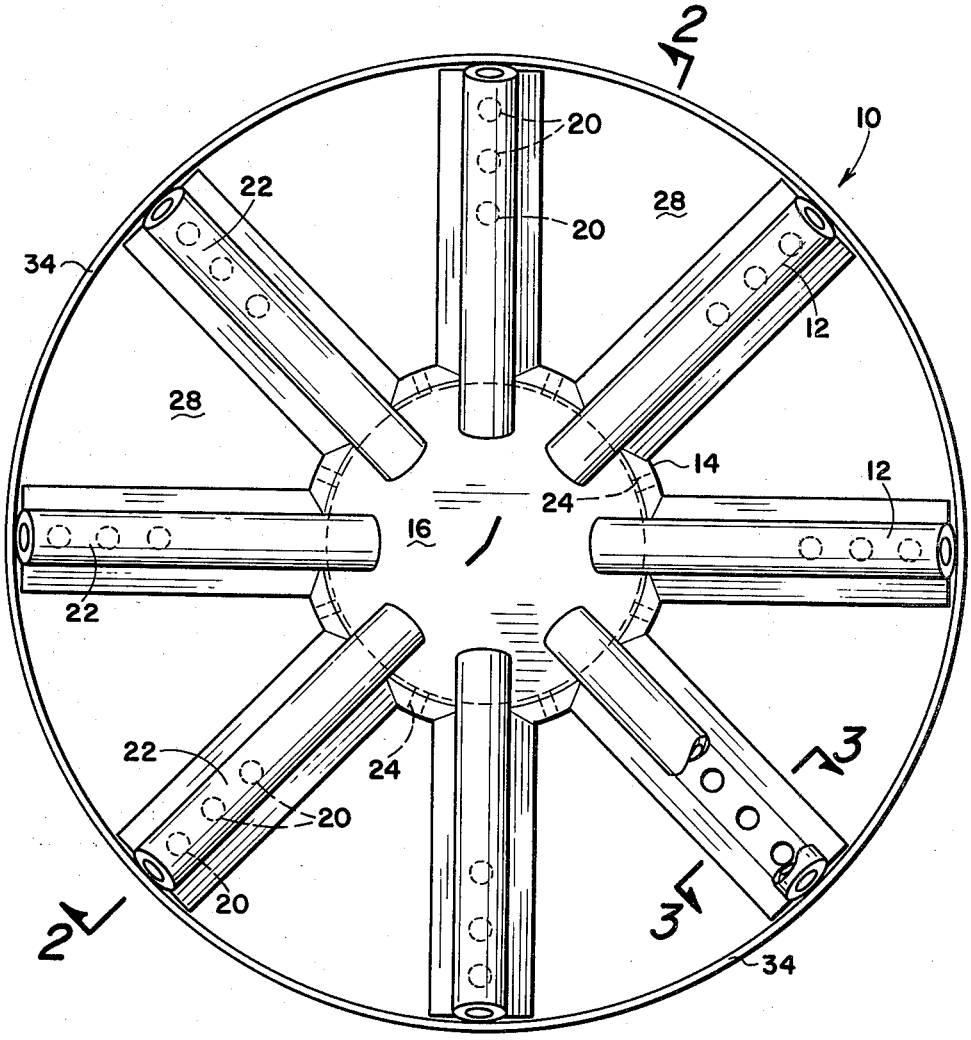
FIGS. 1 and 2 represent a plan view and a vertical diametral cross-section of the burner head of this invention.
Figure 2:
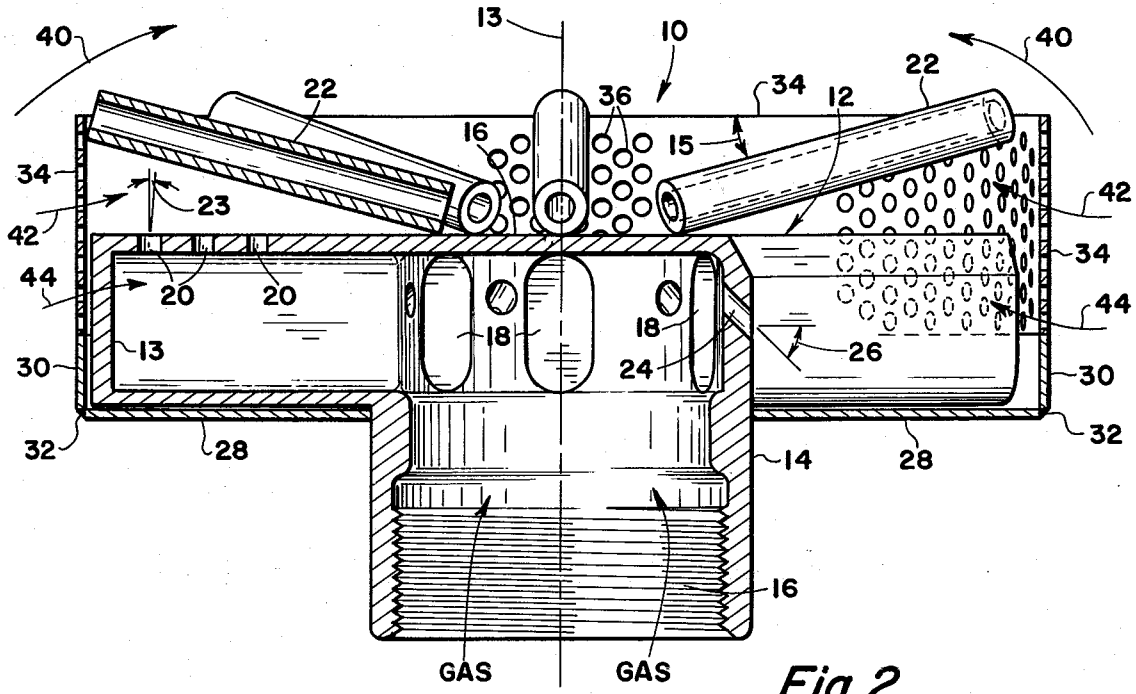

Referring now to the drawings and, in particular, to FIGS. 1 and 2, the construction of the burner head of this invention, for the combustion of low calorific value gases is shown. The construction comprises a burner hub 14 which is a closed top cylindrical fixture adapted to be positioned on top of a vertical pipe (not shown) and attached by means of threads 16, through which the lean gas is supplied to the burner. A plurality of radial arms 12 are attached to the outer surface of the hub 14, with the top surface of the arms in a common plane with the top surface of the hub.

The gas which is supplied to the hub passes through openings 18 in the wall of the hub, through the arms 14 out toward the closed ends 13. A plurality of ports or orifices 20 are provided along the center line of each of the arms, near the ends. The axis of each of these ports is tilted inwardly towards the central vertical axis 13 of the head, by a selected small angle A, indicated by numeral 23, which may be preferably in the range of 5° to 30°.

Mounted directly above the orifices 20 in each of the arms is a cylindrical tube or nipple 22, which is attached, as by welding, to the top surface of the arms and to the wall 34, at a selected angle B identified by the numeral 15. This angle would preferably be equal to the angle A of the jets so that the gas flowing upwardly and inwardly from the ports would impinge radially on the outer surface of the nipples and in a sense would "spatter" in all directions, providing a turbulent mixing, between the air and the gas moving in all possible directions.

Figure 4:
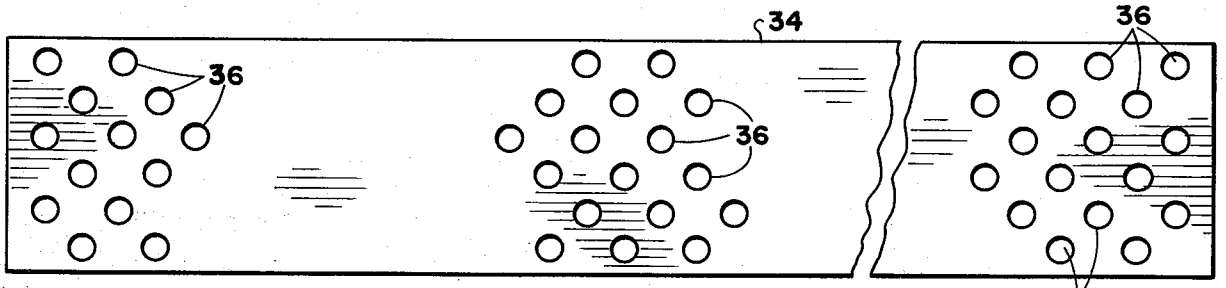
FIG. 4 illustrates the construction of the low, circumferential shroud or wall surrounding the ends of the arms of the burner head.

The inward tilt of the axes of the orifices is to aspirate air inwardly through the outer wall 34, which, as shown in FIG. 4, is perforated with a plurality of openings 36, in a selected two-dimensional array, over substantially the entire area of the wall, or shroud. The air moving inwardly through the openings in the wall 34 mix with the rapidly moving gas, to provide the abundance of air which is necessary for smokeless combustion.

Additionally, there is another plurality of ports, comprising at least one port identified by numeral 24, through the outer wall of the hub, in the space between each of the adjacent pairs of arms 12. These inter-arm ports 24 are directed downwardly and outwardly from the hub surface at a selected angle B, which may be in the range of about 45°. The angle is identified by numeral 26.

An annular plate 28 surrounds the hub 14 and is attached to the under surface of the arms so as to completely close off vertical movement of air upwardly from below the head between the arms.

All combustion air required for the burning of the gas is diffused or aspirated inwardly through the openings 36 in the surrounding wall or shroud 34. Additional combustion air is, of course, aspirated inwardly over the top edge of the wall 34.

The combustion air, which is diffused and aspirated inwardly through the walls 34, would be as indicated by arrows 42 over the arms, and in accordance with arrows 44 into the space between the arms.

The gas jets, although of sonic velocity, are not directed as a group in a vertical direction, the column of burning gas moves more slowly in an upward direction over the top of the burner head. This slow vertical movement helps to maintain continuity of the flame, and the ignition of fresh gas being supplied through the various ports.

Figure 3:
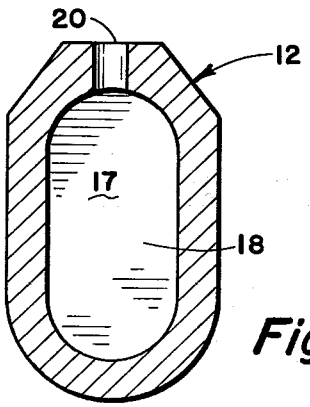
FIG. 3 illustrates the cross-section of a typical hollow arm of the head of FIGS. 1 and 2.

FIG. 3 needs no further explanation since it shows a cross-section taken along the plane 3—3 in FIG. 1, and shows the typical shape of the arms. The arms have a central gas volume space 17 through a cross-sectional opening of an oval shape indicated by the numeral 18. The cross-section is taken through the center of one of the ports 20 in the top surface of the arm.

FIG. 4 illustrates the type of perforated character of the wall 34. Here the wall is shown in a flat pattern and would, of course, be rolled into a circular wall and welded prior to attachment to the outer ends of the arms of the burner head.

While this invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element or step thereof is entitled.

What is claimed is:

1. Apparatus for burning low calorific gases in smokeless combustion comprising:

(a) at least one burner head mounted on the top of a vertical pipe, through which said low calorific gases are supplied;

(b) a plurality of hollow arms inserted into the wall of said head arranged in equally-spaced radial array in a common horizontal plane, said arms closed at their outer ends;

(c) a plurality of ports of selected diameter and selected spacing near the outer ends of said arms drilled through the tops of said arms; the direction of the axes of said ports inclined toward the vertical axis of said head, at a selected angle A;

(d) at least one port drilled through the circumferential wall of the central hub of said head in each of the spaces between adjacent radial arms; the angle of said at least one port being at a selected angle B down from the horizontal, from the inside of the hub to the outside;

(e) the pressure of said gas supplied to said head being such that the velocity of the jets of gas flowing from said ports is excessive and up to critical;

(f) an annular circular plate positioned in contact with the bottom surfaces of said arms closing off the spaces between said arms; and (g) a thin cylindrical wall surrounding the ends of said arms in contact at its bottom edge with the outer edge of said annular plate, and rising a selected distance above said arms; a plurality of openings in said wall of a selected size in a selected symmetrical pattern over substantially the entire area of said wall.

2. The apparatus as in claim 1 including a tubular element of selected diameter and length mounted above said plurality of ports in the tops of said arms, one element over each of said arms; said elements tilted so as to be substantially perpendicular to the direction of the axes of said ports.

3. The apparatus as in claim 2 including a plurality of said burner heads, mounted in a horizontal plane, in a selected spaced relation.

4. The apparatus as in claim 1 in which said angle A is in the range of 5° to 30° to the vertical.

5. The apparatus as in claim 1 in which said angle B is in the range of 40° to 50° to the horizontal.

* * * * *